US006942113B1

(12) United States Patent
Johnske et al.

(10) Patent No.: US 6,942,113 B1
(45) Date of Patent: Sep. 13, 2005

(54) POINT OF PURCHASE DISPLAY

(75) Inventors: David A. Johnske, Bolingbrook, IL (US); Renee E. Richardson, Sun Valley, CA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 663 days.

(21) Appl. No.: 09/609,662

(22) Filed: Jun. 30, 2000

(51) Int. Cl.[7] ..... A47J 47/00; A47B 81/06

(52) U.S. Cl. ..... 211/133.1; 211/131.1; 312/9.1

(58) Field of Search ..... 345/2, 905; 211/132.1, 211/126.16, 72, 73, 13, 131.1, 133.1, 149; 248/174; 229/120.06; 312/72, 9.1, 9.32

(56) References Cited

U.S. PATENT DOCUMENTS 3,960,273 A * 6/1976 Weston ..... 211/165
5,630,518 A * 5/1997 Collins ..... 211/132.1
5,826,732 A * 10/1998 Ragsdale ..... 211/149
5,836,455 A * 11/1998 Connor et al. ..... 206/757
5,868,367 A * 2/1999 Smith ..... 248/174
5,984,120 A * 11/1999 Johnske ..... 211/126.16
6,003,804 A * 12/1999 Vara ..... 211/13.1
6,068,139 A * 5/2000 Brozak, Jr. ..... 211/169
6,189,710 B1 * 2/2001 Mason ..... 211/131.1

* cited by examiner

*Primary Examiner*—Regina Liang
*Assistant Examiner*—Duc Q Dinh
(74) *Attorney, Agent, or Firm*—Armstrong Teasdale LLP

(57) ABSTRACT

A point of purchase display for the containment and presentation of products, incorporating one or more cartridges for holding the products, the one or more cartridges being operably supported by a brace member within a shell. The shell, brace and cartridge(s) are all preferably fabricated from corrugated paperboard material. In an alternative embodiment of the invention, a plurality of assembled displays is modularly connected to provide an integrated display unit.

22 Claims, 16 Drawing Sheets

POINT OF PURCHASE DISPLAY

BACKGROUND OF THE INVENTION

1. Field of the Invention

The present invention is directed to point of purchase displays, in particular point of purchase displays (POP's) for small products, like compact discs (CD's) or digital video discs (DVD's). The present invention is directed in particular to such point of purchase displays that are fabricated from paper, paperboard, and corrugated paper and corrugated paperboard materials.

2. Prior Art

Point of purchase displays for small size goods are well known. Such displays are often fabricated from metal or plastic, and are fabricated to be quickly set up and knocked down, in order to accommodate the needs of the particular business establishment, as well as the changing promotional events that prompt the use of the point of purchase display.

However, such metal and/or plastic displays are typically very generic in shape, little more than open-topped or open-front bins in which the goods are piled or stacked. Furthermore, such metal and/or plastic displays can be relatively heavy and/or bulky, even in their broken down form, and can be relatively expensive to fabricate, especially since they are not always intended for multiple uses, and are discarded after only one use.

Point of purchase displays for small articles, that have been fabricated from paper, paperboard, and corrugated paper and corrugated paperboard are known. Such point of purchase displays have the advantage of typically being lighter in weight than comparable metal or plastic structures. In addition, such displays are typically less expensive to manufacture and ship. Furthermore, such displays are often more amenable to recycling than metal or plastic structures, once their function as a display has been completed.

However, like the metal or plastic displays, such prior art paper/paperboard/corrugated paper or paperboard displays likewise are often rather unimpressive visually, and often rely upon decorative printed labels and the like to provide "eye-catching interest".

As such, it would be desirable to provide a point of purchase display that is relatively easy to manufacture and ship.

It would further be desirable to provide a point of purchase display that is relatively easy to set up or take down.

It would further be desirable to provide a point of purchase display that is fabricated from paper, paperboard, corrugated paper and/or corrugated paperboard, that is relatively light in weight and recyclable.

It would also be desirable to provide such a point of purchase display that is visually striking and presents the articles being displayed in a facilitated, easy to use manner.

It would also be desirable to provide a point of purchase display that is modular in nature, in that individual display units are provided that may be used singly, or in modular combinations thereof.

These and other desirable characteristics of the invention will become apparent in light of the present specification, including claims, and drawings.

SUMMARY OF THE INVENTION

The present invention is directed to a point of purchase display apparatus for the facilitated display of products, comprising at least one cartridge, having an open face, for containing a plurality of products; at least one self-supporting display shell having a display opening in a face thereof. The at least one self-supporting display shell is operably configured for enabling positioning of the open face of the at least one cartridge in alignment with at least a portion of the display opening of the at least one self-supporting display shell. At least one brace member is operably configured for supporting the at least one cartridge within the at least one self-supporting display shell, to place the open face of the at least one cartridge in alignment with at least a portion of the display opening of the at least one self-supporting display shell.

A preferred embodiment of the invention further comprises means for controlling removal of products from the display, operably configured to substantially preclude the simultaneous removal of more than one product from a single cartridge from the display apparatus. The means for controlling removal of products from the display preferably comprises at least one tab member operably emanating from a side edge of the display opening, the at least one tab member being further operably located, relative to the open face of the at least one cartridge, so that not more than one product can pass between an edge of the open face of the at least one cartridge and the at least one tab member, without requiring destructive mutilation of at least some portion of the display apparatus.

In an embodiment of the invention, the display shell is operably configured to enable a plurality of cartridges to be positioned with their open faces in alignment with portions of the display opening. The brace member is preferably operably configured for supporting the plurality of cartridges with their open faces in alignment with portions of the display opening.

The point of purchase display apparatus, according to an embodiment of the invention, further comprises a plurality of self-supporting display shells, each display shell being provided with at least one brace member, supporting at least one cartridge.

In such an embodiment, the plurality of self-supporting display shells may be substantially identical in configuration.

In such an embodiment, the point of purchase display apparatus may further comprise means for modularly connecting the plurality of self-supporting display shells.

The means for modularly connecting the plurality of self-supporting display shells may comprise a bottom form structure, operably configured to receive and stabilize bottom ends of at least two self-supporting display shells. A standing form may be operably configured to engage and connect at least two self-supporting display shells to one another. The means for modularly connecting the plurality of self-supporting display shells may further comprise a lock member operably configured to engage and connect at least two self-supporting display shells to one another.

In the point of purchase display apparatus where a plurality of display shells are provided, the display apparatus may further comprise means for facilitating transportation of the plurality of self-supporting display shells. Each display shell being provided with at least one brace member, supporting at least one cartridge, the means for facilitating transportation may comprise a bottom cap, operably configured to receive and stabilize bottom ends of at least two self-supporting display shells; a top filler member, operably configured to rest atop top ends of at least two self-supporting display shells; a top cap, operably configured to receive and stabilize the top filler member, and, in turn, top ends of at least two self-supporting display shells; and a shroud, operably configured to surround at least two self-supporting display shells. The bottom cap being may further operably be configured to receive and restrain a bottom edge region of the shroud, and the top cap may further be operably configured to receive and restrain a top edge region of the shroud.

DETAILED DESCRIPTION OF THE DRAWINGS

Figure 1:
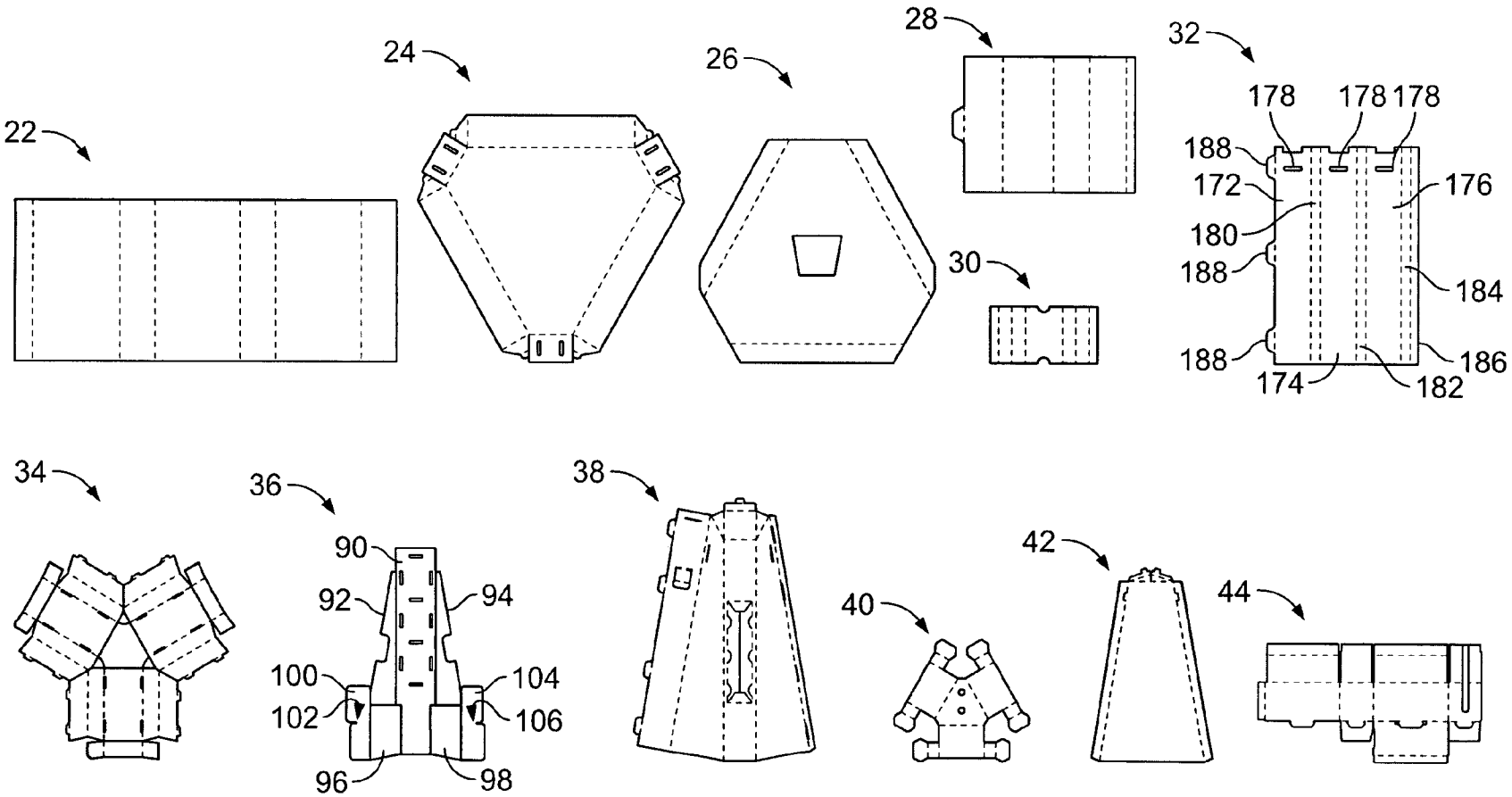
FIG. 1 is a chart illustrating various components for assembling the point of purchase displays of the present invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

The present invention is directed to point of purchase displays in several embodiments. One embodiment employs a single tower unit. Another embodiment employs plurality tower units, connected in modular fashion. Another embodiment is a countertop "tower". All of the units employ "cartridges" for actually holding the products within the supporting towers.

The point of purchase displays of the present invention may be shipped to the ultimate destination in broken down form, or they may be erected, even filled with product, and then shipped. In such cases, dunnage structures are provided, for providing protection, support and stability to the erected point of purchase displays, during shipment.

While the description, and drawing captions may make reference to DVD's as being the product that is intended to be displayed in the point of purchase displays of the present invention, it is to be understood that other types of products, that have rectangular parallelepiped configurations, may be displayed, and that one of ordinary skill in the art, having the present disclosure before them, will be able to make such suitable modifications in dimensions, etc., to accommodate such other kinds of products.

FIG. 1 is a chart illustrating various components for assembling the point of purchase displays of the present invention. For two of the embodiments of the present invention, the floor-standing single and plural tower embodiments, several of the components shown in FIG. 1 are common to both embodiments, as will be addressed in further detail herein. Others of the components shown in FIG. 1 are to be used solely with the plural tower embodiment, and will be identified as such herein. The components of FIG. 1 are not shown to scale, relative to one another.

Shroud 22, top and bottom cap 24 and shipping filler 26 are dunnage devices used only when a plural tower point of purchase display is being shipped pre-assembled.

Center form 32, bottom form 34, top lock 40, and side panels 42 are used solely in forming a plural tower point of purchase display.

Center filler 28, universal filler 30, brace 36, tower shell 38 and cartridges 44 are used in both single and plural tower shell embodiments.

Figure 1A:
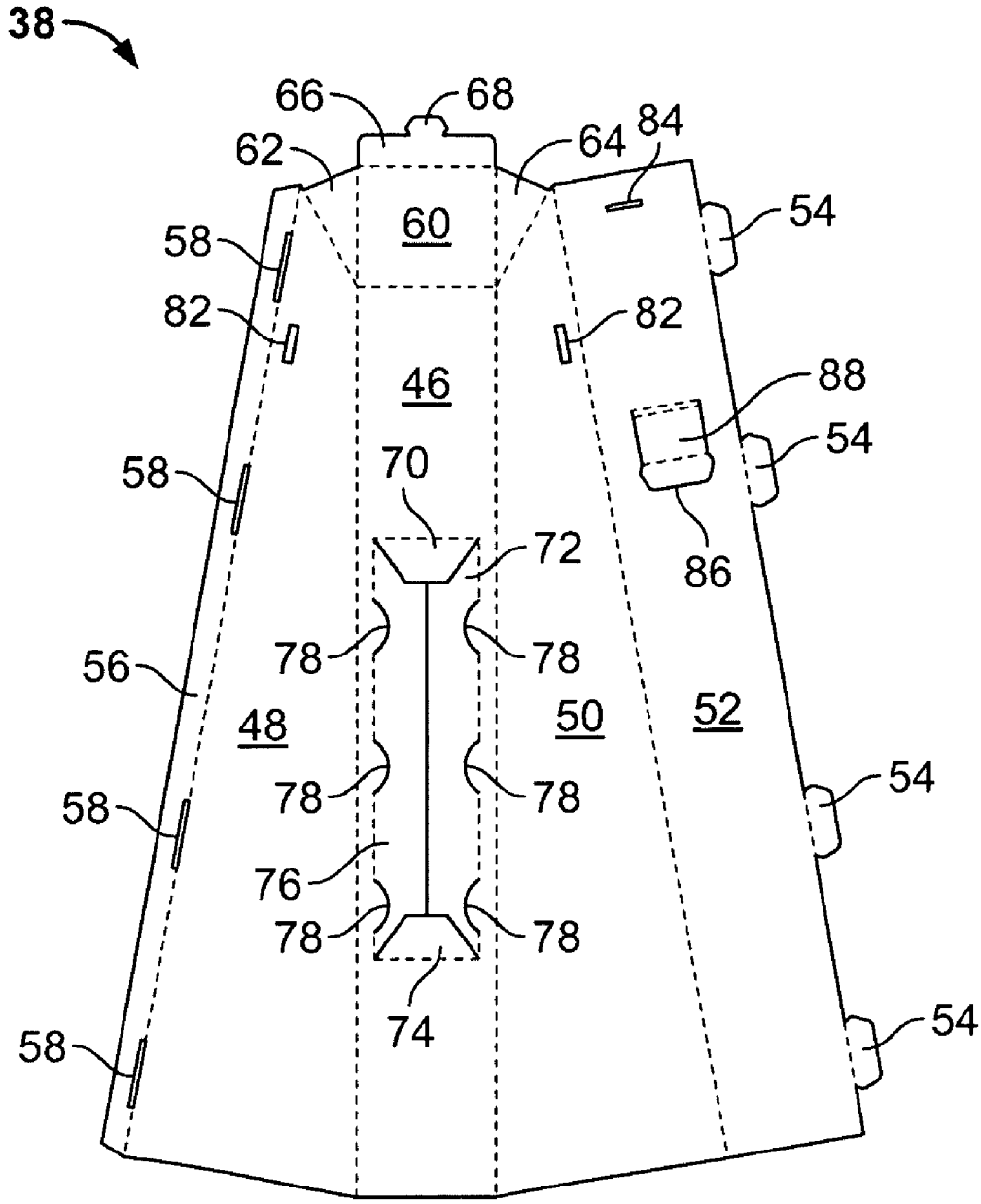
FIG. 1*a* is a plan view of a blank for a tower shell for the point of purchase display, in accordance with a preferred embodiment of the invention.
Figure 2:
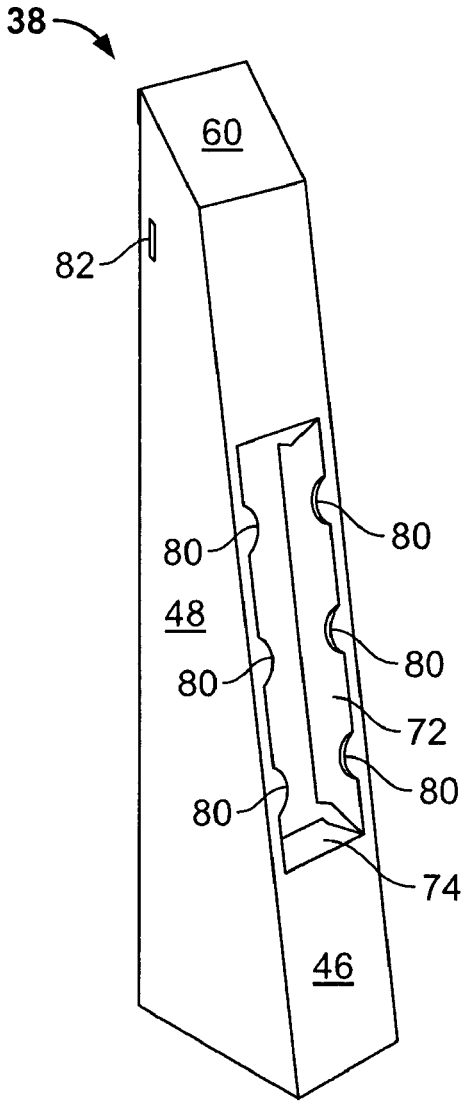
FIG. 2 is a perspective view of the tower shell of FIG. 1, as set up.

FIG. 1*a* is a plan view of a blank for a tower shell for the point of purchase display, in accordance with a preferred embodiment of the invention. FIG. 2 is a perspective view of the tower shell of FIG. 1, as set up.

Tower shell 38 is preferably formed from a single blank of corrugated paperboard material, as shown in FIG. 1*a*. The dashed lines typically indicate fold lines, and solid lines typically indicate cuts, free edges or the crease or edge resulting from a fold, when located in an interior portion of a view. This convention shall apply to the remaining Figures in this present disclosure, unless otherwise specified. One of ordinary skill in the art, having the present disclosure before them, will be able to readily perceive and identify such fold lines, cuts, free edges, creases or edges.

The blank for tower shell 38 comprises outer wall 46, sidewalls 48 and 50, back wall 52, with tabs 54. Strip 56 emanates from sidewall 48, to permit the formation of slots 58. The blank also includes top wall 60, webs 62 and 64, and locking panel 66, with tab 68. Cuts in outer wall 46 form flaps 70, 72, 74 and 76. Arcuate cuts 78 form arcuate tabs 80, when flaps 70–76 are folded inwardly. Slots 82 and 84 are also provided, as is U-shaped cut 86 that forms folding panel 88.

Figure 3:
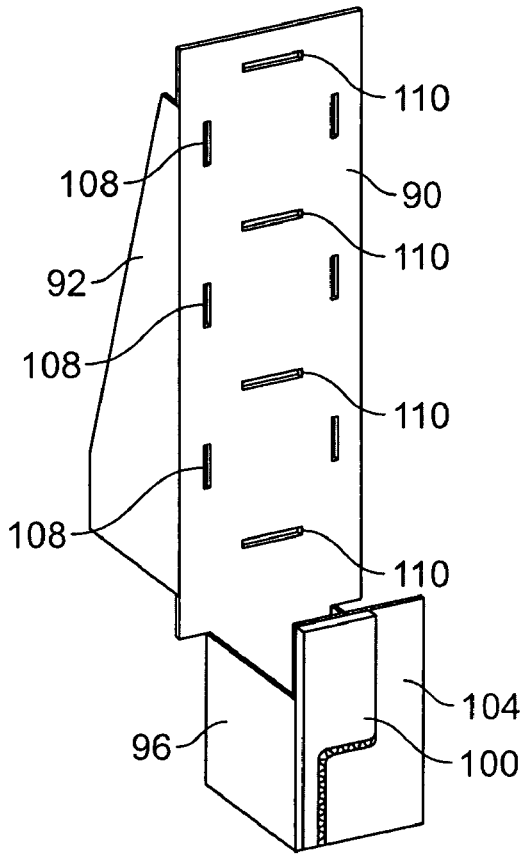
FIG. 3 is a perspective view of the brace for the tower shell of FIG. 1.

FIG. 3 is a perspective view of the brace for the tower shell of FIG. 1*a*. Brace 36 is also shown in FIG. 1. Brace 36 comprises center panel 90, side panels 92 and 94, support walls 96 and 98, locking support wall 100 with slit 102, and locking support wall 104 with slit 106. Side panels 92 and 94 may or may not be provided with rectangular notches on their vertically sloping free edges, as shown in FIG. 1 and omitted in FIG. 3. Vertical slots 108 and horizontal slots 110 are also provided.

Figure 4:
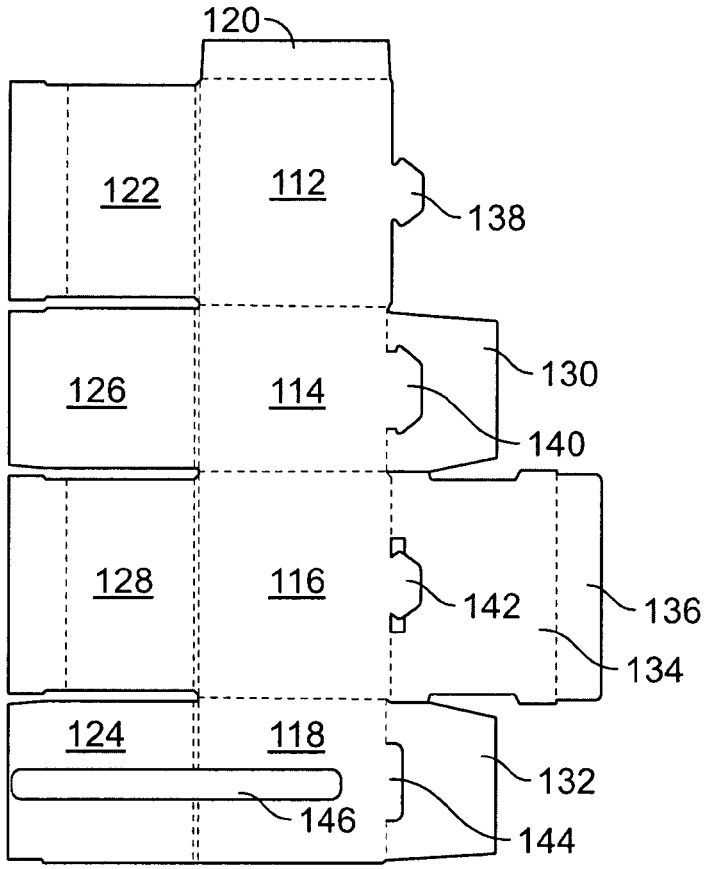
FIG. 4 is a plan view of a blank for a cartridge for holding products that is held within the tower shell.
Figure 5:
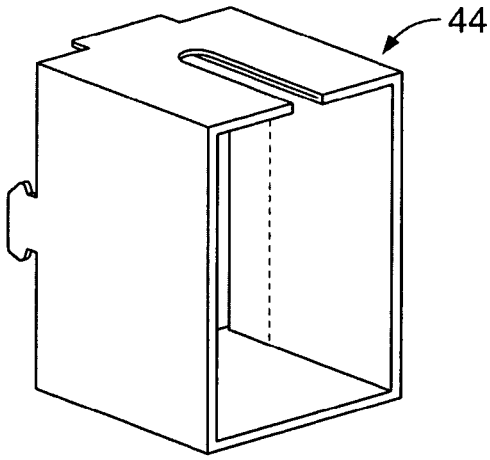
FIG. 5 is a perspective view of a cartridge that has been set up from the blank of FIG. 4.

FIG. 4 is a plan view of a blank for a cartridge 44 for holding products that is held within the tower shell. The blank for cartridge 44 preferably comprises outer panels 112, 114, 116 and 118. Attachment web 120 emanates from outer panel 112. Top side panels 126 and 124 emanate from outer panels 114 and 118, respectively. Top length panels 122 and 128 emanate from outer panels 112 and 116, respectively. Bottom end panels 130, 132 emanate from outer panels 114 and 118, respectively. Bottom length panel 134 emanates from outer panel 116. Flap 136 extends from bottom length panel 134. Tabs 138, 140, 142 and 144 are formed preferably by appropriate die cuts. Elongated generally rectangular slot 146 is formed in outer panel 118 and top side panel 124. FIG. 5 is a perspective view of a cartridge 44 that has been set up from the blank of FIG. 4.

Preferably, all of the tabs in this or any of the embodiments of the invention, that are used to connect the cartridges to respective brace members, are barbed so that the tabs have maximum widths that are slightly greater than the respective slots into which the tabs are to be received. Such a structure aids in holding the cartridges in connection with their respective brace members. This further aids in making it more difficult to accomplish outright removal of a cartridge, in one piece, from a display, without requiring considerable effort and resultant detectable damage to the display.

Figure 6:
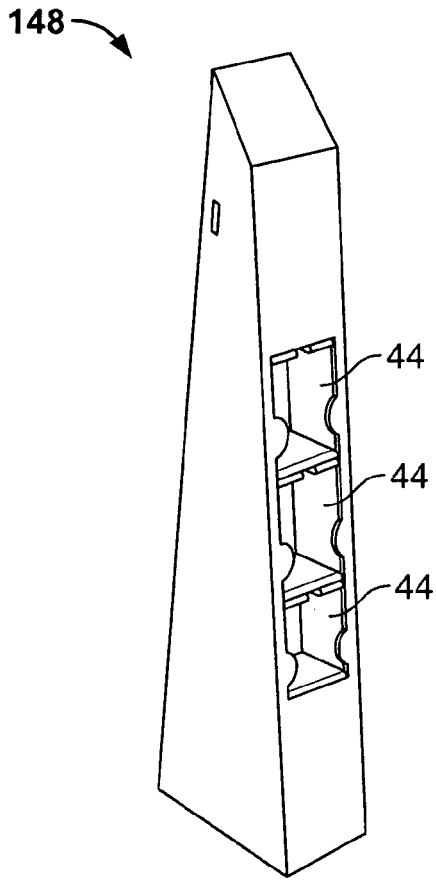
FIG. 6 is a front perspective view of a completely assembled point of purchase display tower, into which a brace and three cartridges have been mounted.

FIG. 6 is a front perspective view of a completely assembled point of purchase display tower 148, into which a brace and three cartridges have been mounted. In one preferred embodiment of the invention, a tower 148 can be used by itself, as a point of purchase display.

In an alternative embodiment of the invention, three such towers 148 can be modularly assembled together, using bottom form 34, center form 32, top lock 40, and three side panels 42.

Figure 7:
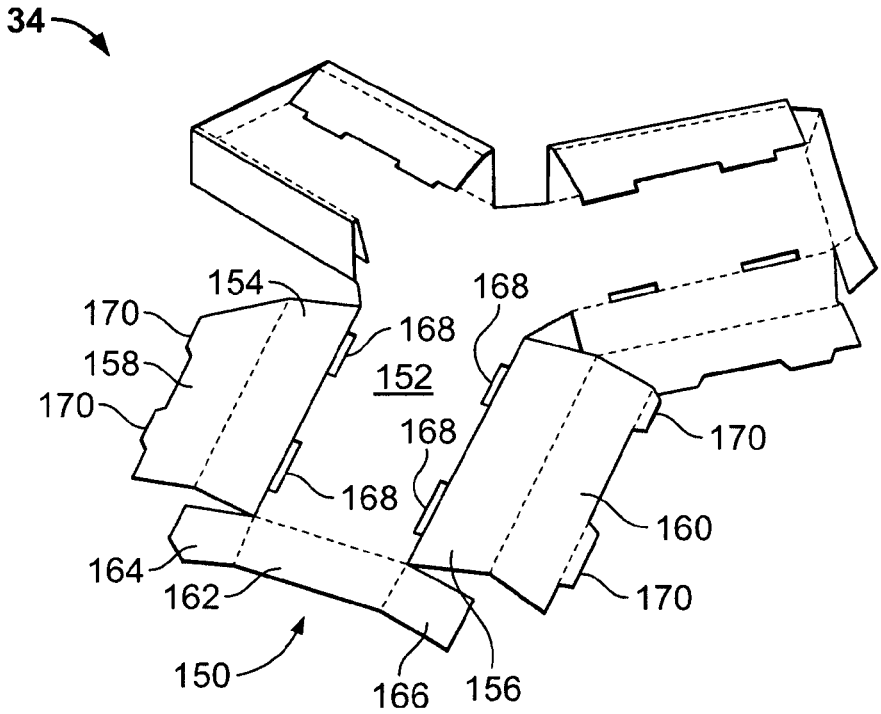
FIG. 7 is a perspective view of a bottom form that has been partially erected, which may be used in an alternative embodiment of the invention, in which plural tower shells may be used.

FIG. 7 is a perspective view of a bottom form 34 that has been partially erected, which may be used in an alternative embodiment of the invention, in which plural tower shells may be used. The blank from which form 34 is formed has three branches 150, preferably at 120° angles to one another. In FIG. 7, one branch of bottom form 34 has been completely erected, one is in the process of being erected, and one is shown still flat, to facilitate viewing of the several panels. In a preferred embodiment, all the branches are identically configured. Each branch includes a central panel 152, two outer side panels 154 and 156, two inner side panels 158 and 160 emanating from the respective outer side panels, an end panel 162 and two support flaps 164 and 166. Four slots 168 are provided to receive tabs 170, when outer side panels 154, 156 are folded perpendicular to central panel 152, and inner side panels 158, 160 are further folded inward to be parallel and in overlying relation to outer side panels 154, 156.

Figure 8:
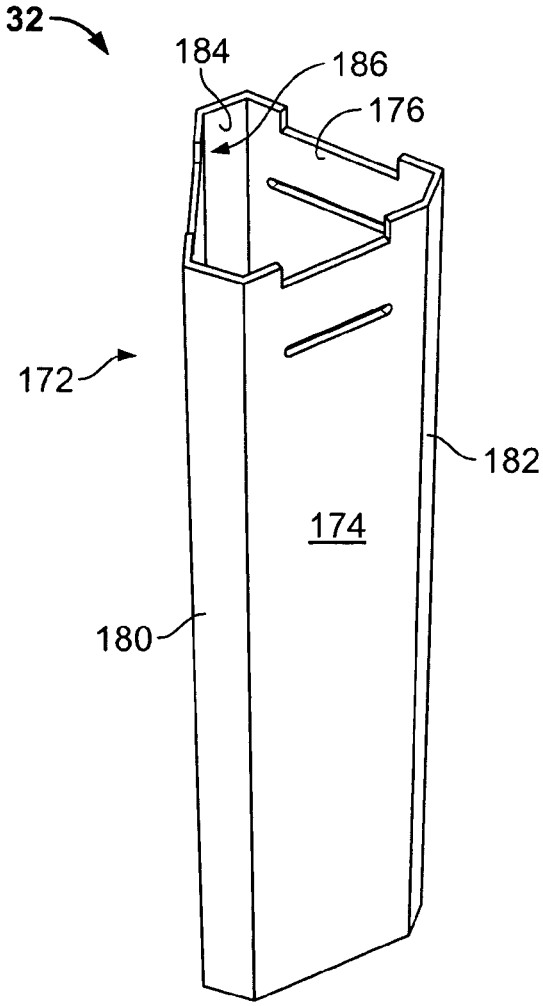
FIG. 8 is a perspective view of the center form that has been erected, which may be used in an alternative embodiment of the invention, in which plural tower shells may be used.

FIG. 8 is a perspective view of the center form 32 (also shown in FIG. 1) that has been erected, which may be used in the alternative embodiment of the invention, in which plural towers 148 may be used. Center form 32 includes three wide elongated panels 172, 174 and 176. Each of panels 172, 174 and 176 has a horizontal slot 178 located near its top edge. Panels 172 and 174 are separated by a thin panel 180. Panels 174 and 176 are separated by a thin panel 182. Two thin panels 184, 186 emanate from an opposite side of panel 176. Tabs 188 emanate from a free edge of panel 172, and are configured to fit into suitably located slots (not shown) preferably positioned along the vertical fold line between panels 184 and 186. Assembly of center form 32 may readily be obtained by folding the blank along all the vertical fold lines, to obtain the shape indicated in FIG. 8, and then inserting the tabs 188 into their respective slots.

Figure 9:
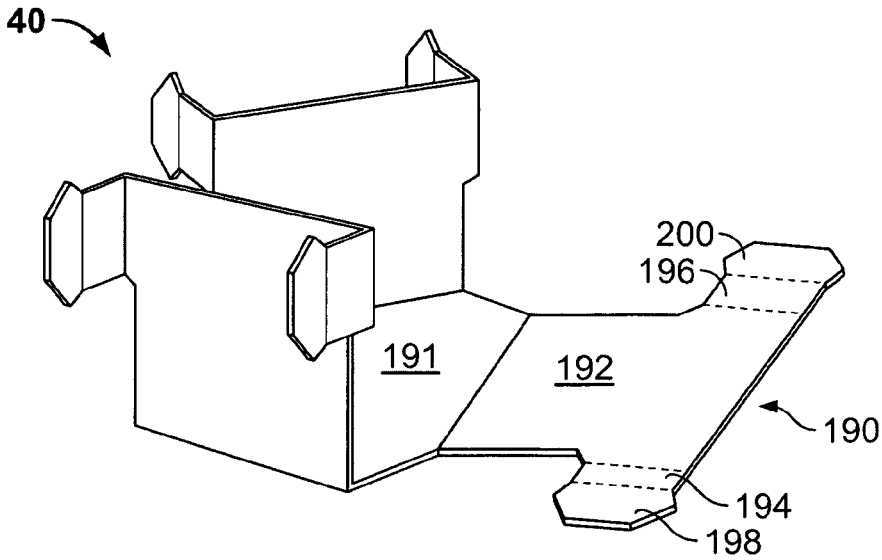
FIG. 9 is a perspective view of a top lock, for use with the center form of FIG. 8.

FIG. 9 is a perspective view of top lock 40, for use with center form 32 of FIG. 8. Like bottom form 34, top lock 40 preferably has three branches 190, emanating from a triangular central panel 191. Each branch 190 has a center panel 192, two side panels 194 and 196, and two tabs 198 and 200, emanating therefrom, respectively. In FIG. 8, two branches are shown fully erected, and one shown lying flat.

Figure 10:
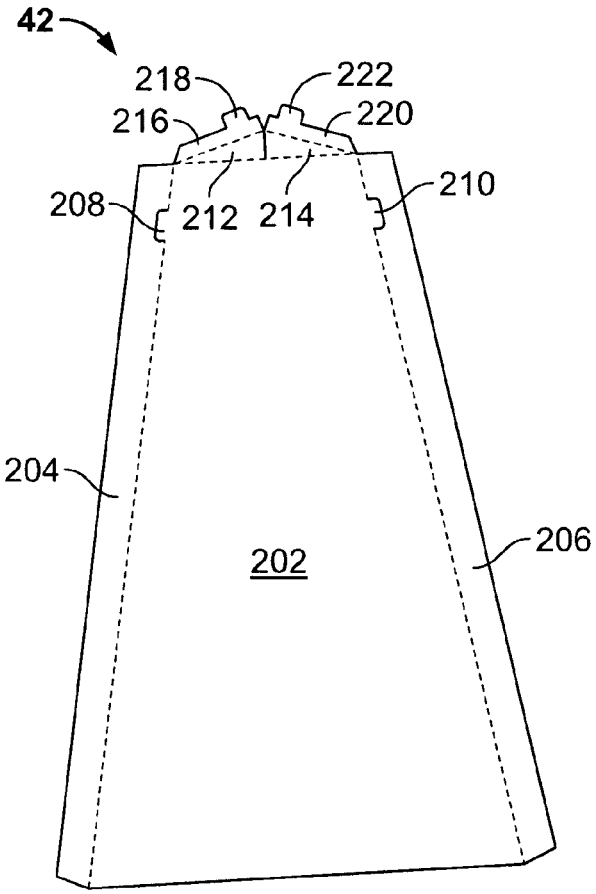
FIG. 10 is a plan view of a side panel, which may be used, in an alternative embodiment of the invention, in which plural tower shells may be used.

FIG. 10 is a plan view of a side panel 42, three of which may be used, in the alternative embodiment of the invention, in which plural towers 148 may be used. Two thin panels 204 and 206 emanate from opposite sides of center panel 202. Two "C"-shaped cuts define tabs 208 and 210. Two triangular top panels 212 and 214 emanate from the top edge of center panel 202. Flap 216 with tab 218 emanates from top panel 212. Flap 220 with tab 220 emanates from top panel 214.

Figure 11:
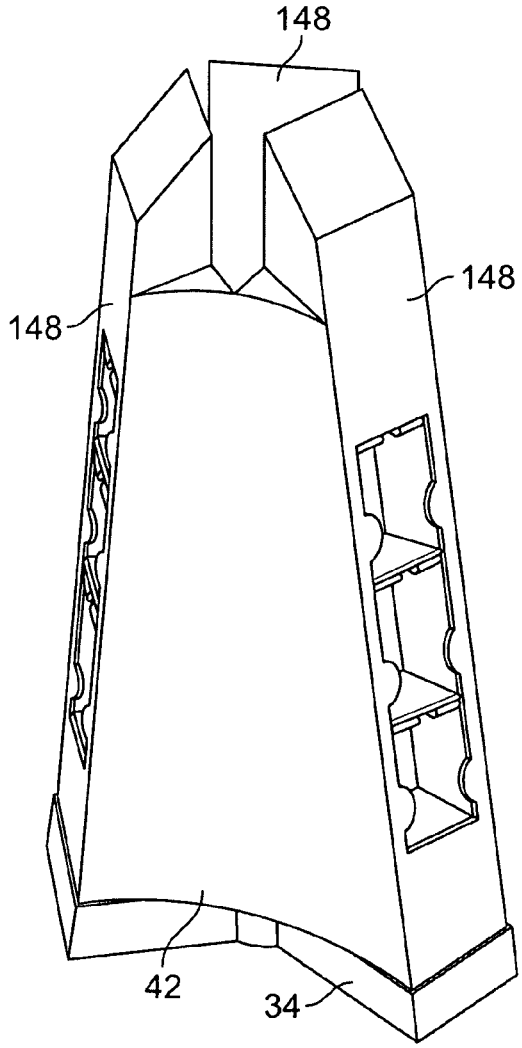
FIG. 11 is a perspective view of a fully erected point of purchase display, in an alternative embodiment of the invention, in which plural tower shells may be used.
Figure 12:
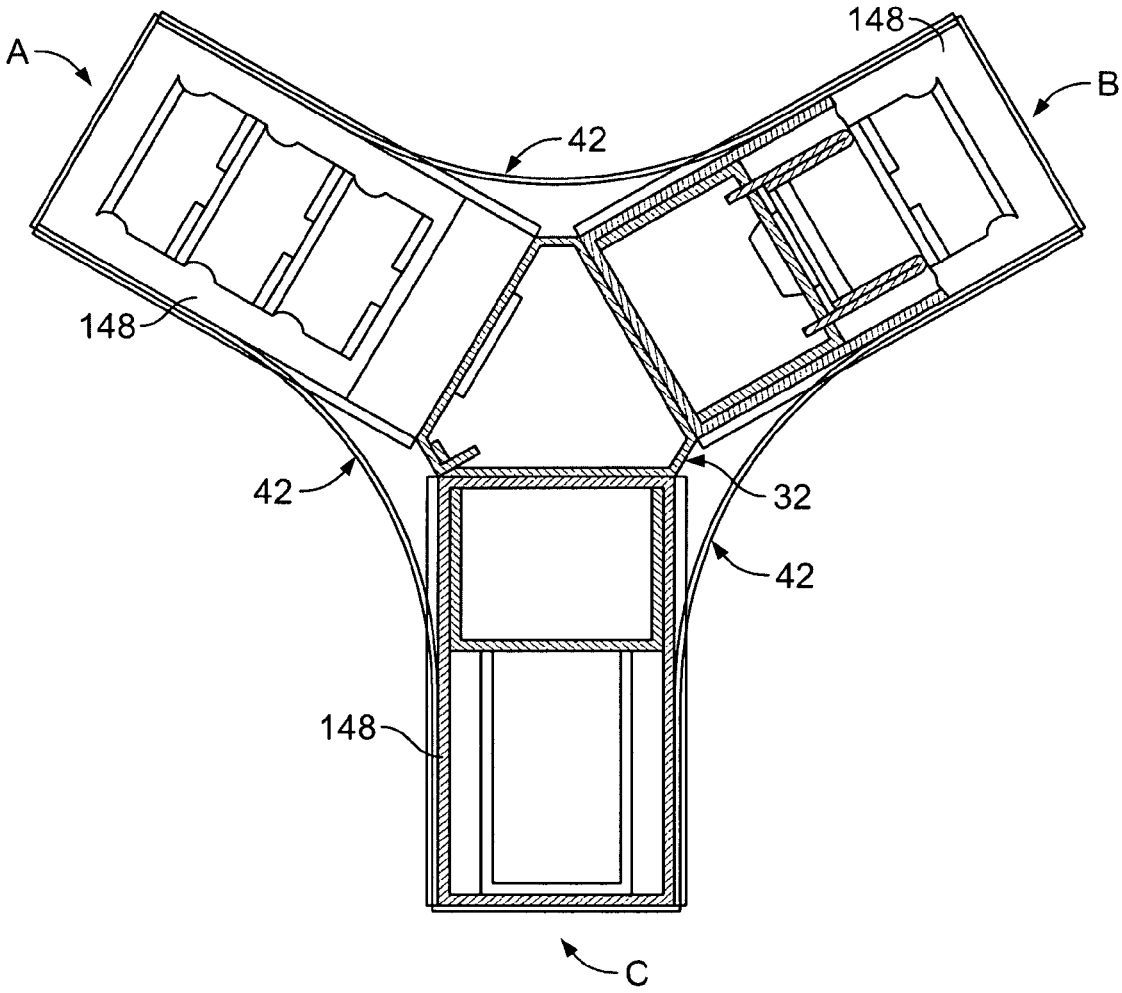
FIG. 12 is a top view, partially in section, of the point of purchase display of FIG. 11.
Figure 12A:
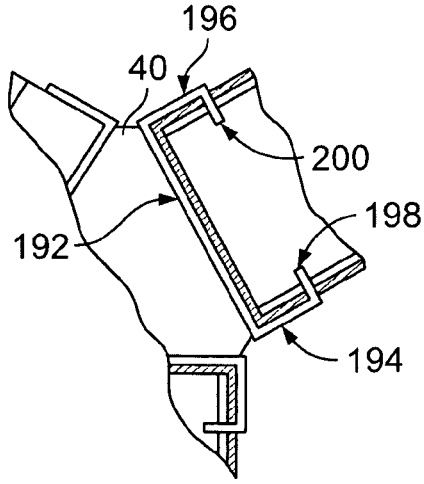
FIG. 12*a* is an enlarged, close-up partially sectional view of the top of the point of purchase display of FIG. 11, showing the engagement of the top lock and one of the tower shells.
Figure 13:
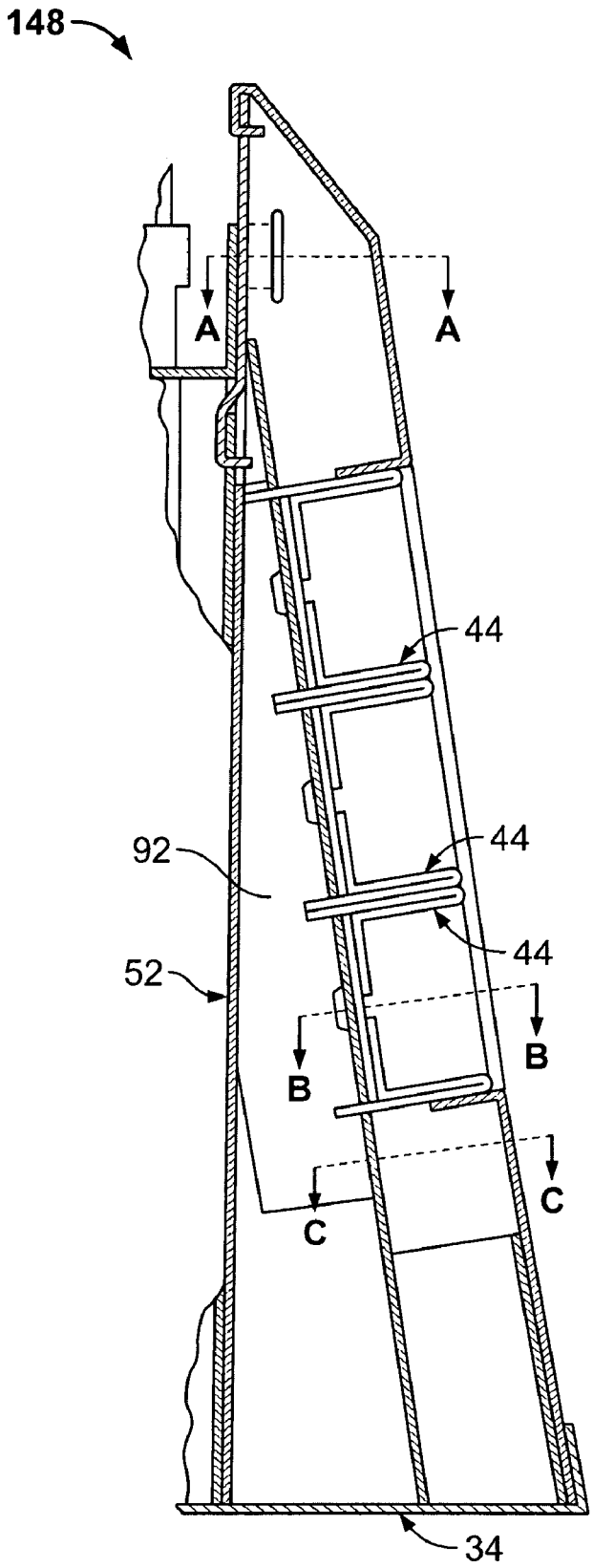
FIG. 13 is a side elevation, in section of one of the tower shells, as used in the point of purchase display in the embodiment of FIG. 11.
Figure 13A:
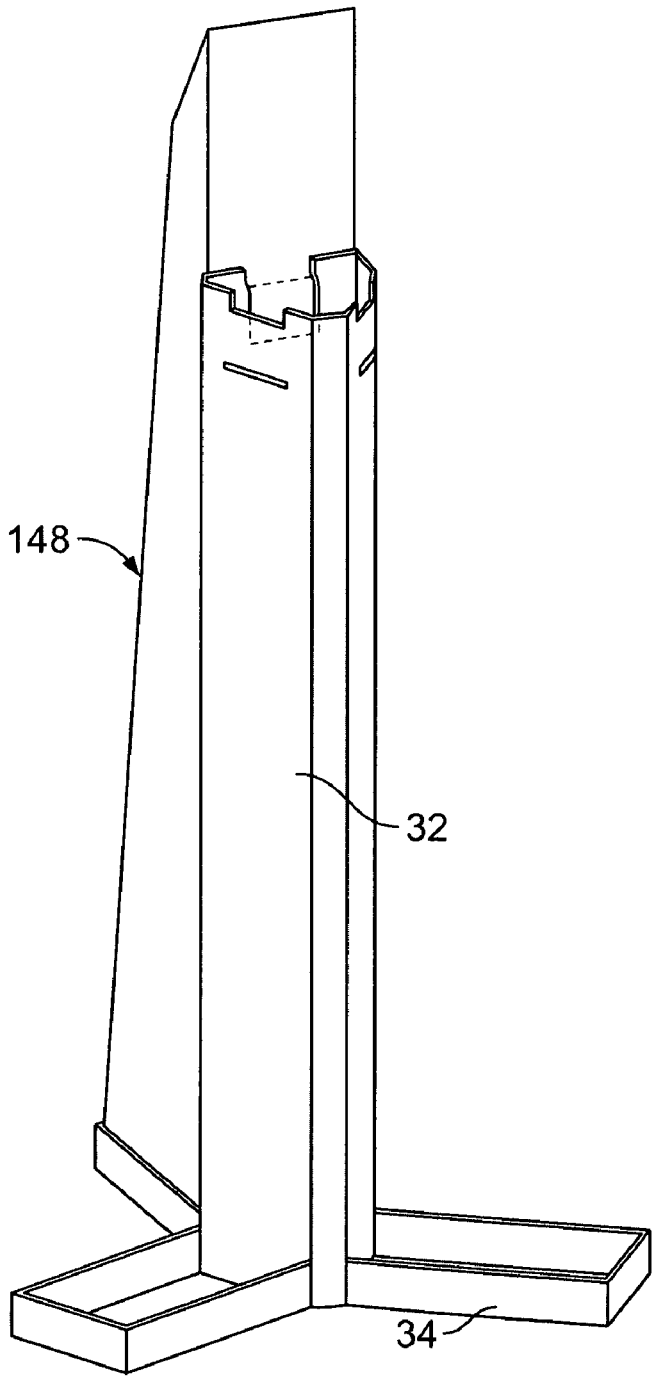
FIG. 13*a* is a rear perspective view of a partially set up point of purchase display of FIG. 11, showing the engagement of one tower shell, with the bottom form and the center form.

FIG. 11 is a perspective view of a fully erected point of purchase display, in an alternative embodiment of the invention, in which three towers 148 are used. FIG. 12 is a top view, partially in section, of the point of purchase display of FIG. 11. In particular, three different sections A, B and C are shown that are taken along different positions along the height of the display, as indicated in FIG. 13. FIG. 12*a* is an enlarged, close-up partially sectional view of the top of the point of purchase display of FIG. 11, showing the engagement of the top lock and one of the tower shells. FIG. 13 is a side elevation, in section of one of the tower shells, as used in the point of purchase display in the embodiment of FIG. 11. FIG. 13*a* is a rear perspective view of a partially set up point of purchase display of FIG. 11, showing the engagement of one tower shell, with the bottom form and the center form.

Figure 18:
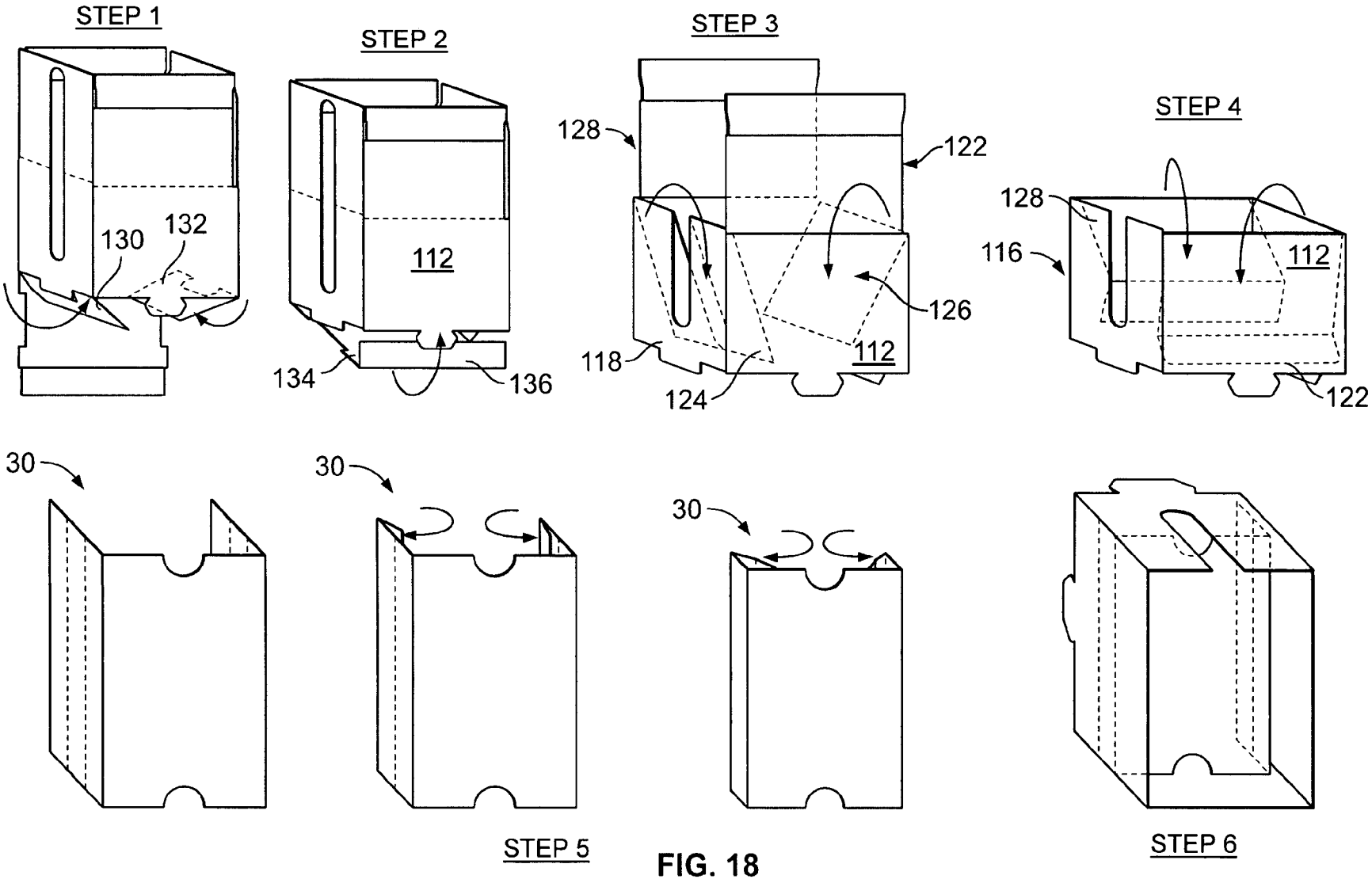
FIG. 18 is a chart illustrating the steps in assembling a cartridge for the point of purchase displays of FIGS. 1*a*–13*a*.
Figure 19:
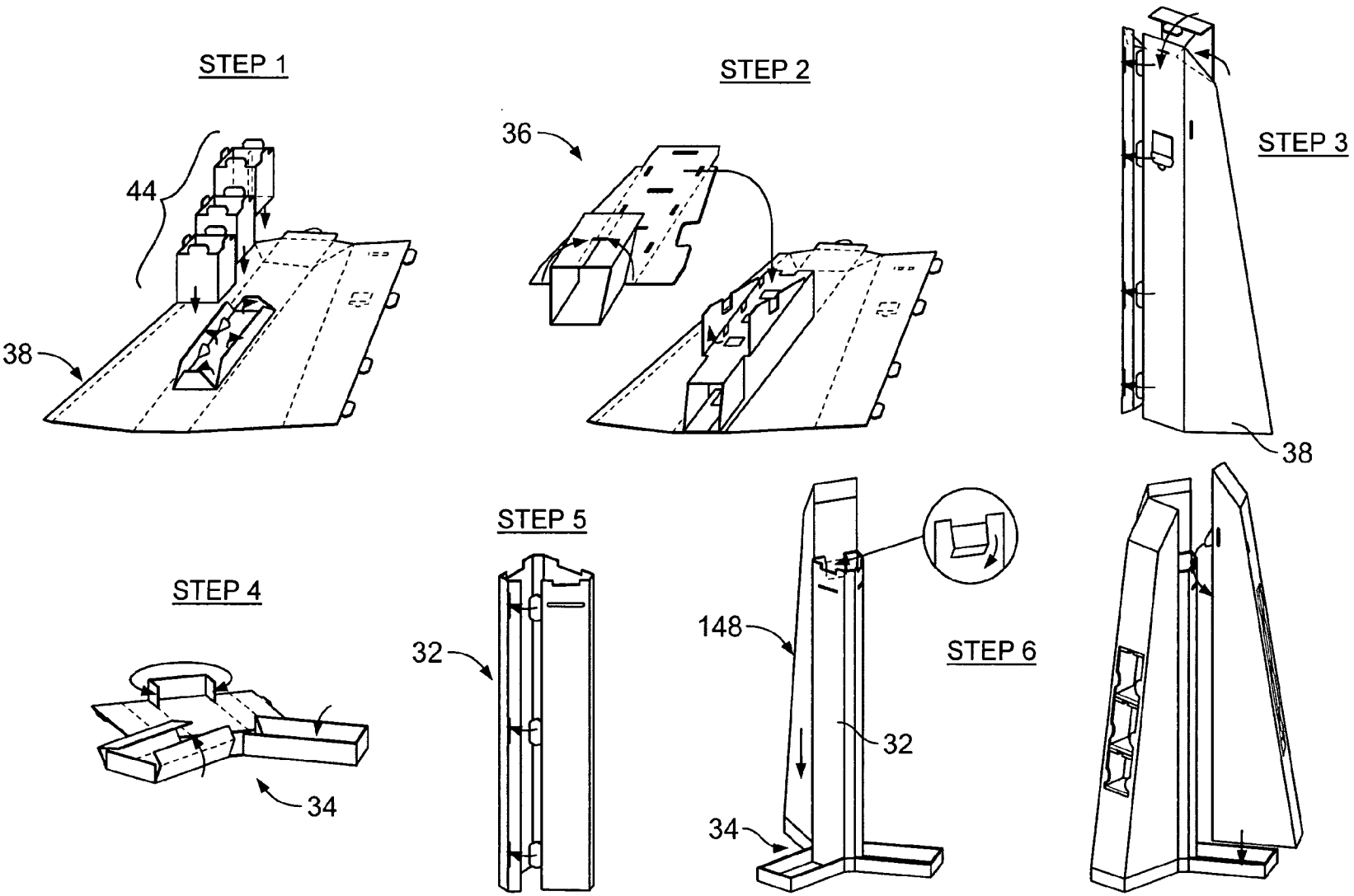
FIG. 19 is a chart illustrating steps in the assembly of the tower for the point of purchase displays of FIGS. 1*a*–13*a*.
Figure 20:
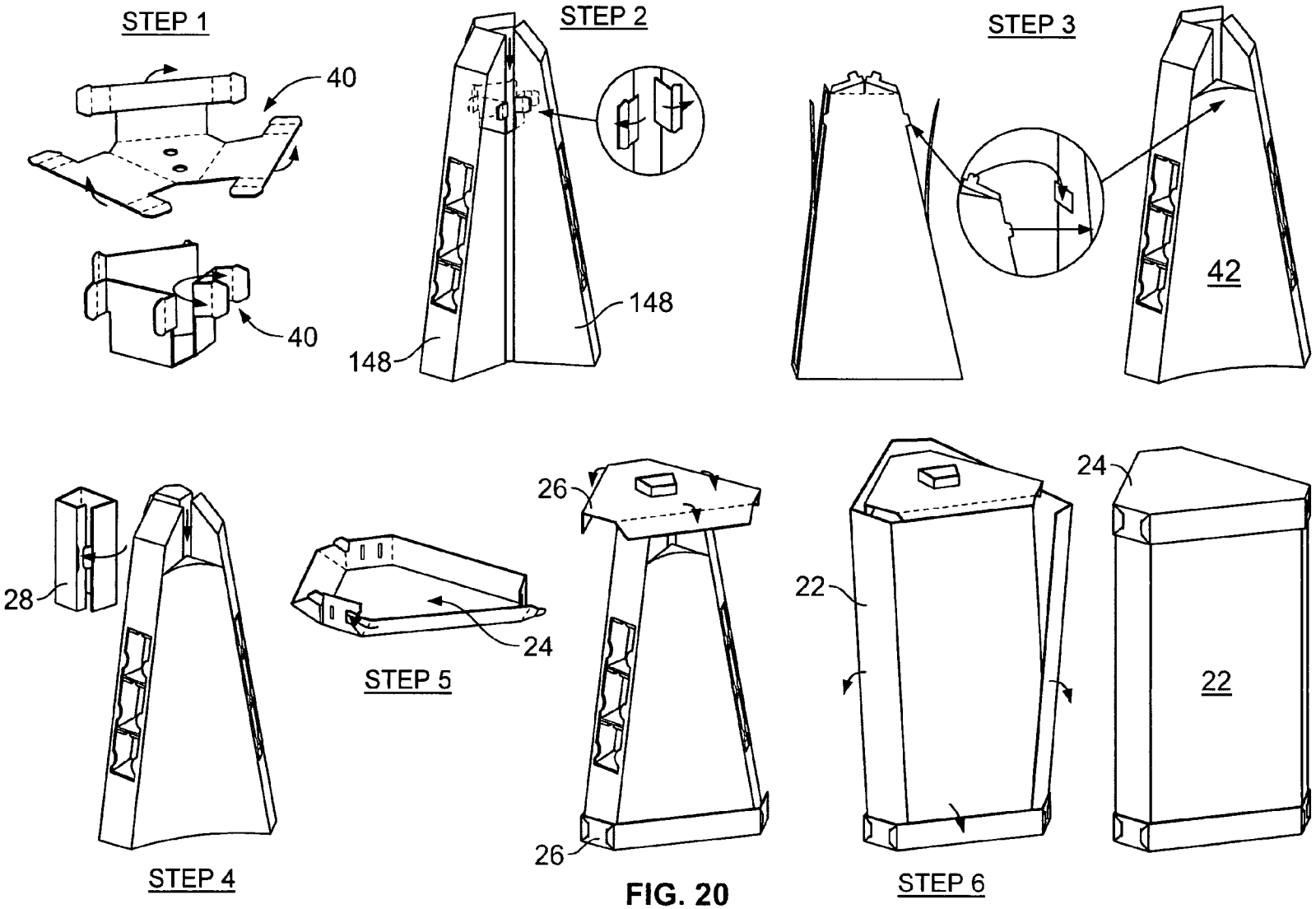
FIG. 20 is a chart illustrating further steps in the assembly of the tower for the point of purchase display, particularly for the point of purchase display that employs plural tower shells.

The assembly of a single tower 148, and its subsequent integration into a modular, three-tower display will now be described. FIG. 18 is a chart illustrating the steps in assembling a cartridge for the point of purchase displays of FIGS. 1*a*–13*a*. FIG. 19 is a chart illustrating steps in the assembly of the tower for the point of purchase displays of FIGS. 1*a*–13*a*. FIG. 20 is a chart illustrating further steps in the assembly of the tower for the point of purchase display, particularly for the point of purchase display that employs plural tower shells.

First, as shown in FIG. 18, a sufficient quantity of cartridges 44 must be assembled. The blank is folded into a rectangular tube, by bending the blank until attachment web 120 overlaps, to the inside, a portion of outer panel 118, and is affixed thereto, preferably by adhesive. This can be done prior to shipment, if desired, and the rectangular tube flattened for shipment. When the tube is ready for formation, bottom end panels 130 and 132 are folded inwardly (Step 1 of FIG. 18). Bottom length panel 134 is then folded across the open end of the cartridge, and flap 136 is inserted into the slot defined by the edge of outer panel 112, and the edges of bottom end panels 130 and 132 (Step 2 of FIG. 18). Top side panels 124 and 126 are then folded in, until they are parallel to outer panels 118 and 114, respectively (Step 3 of FIG. 18). Top length panels 128 and 122 are then folded in until they are parallel to outer panels 116 and 112, respectively (Step 4 of FIG. 18).

At this time, the cartridge may be loaded with product, such as DVD boxes. According to one preferred embodiment of the invention, the depth of the cartridge is configured to enable 11 conventional commercial DVD packages to be received, standing upright on their shortest wall (other configurations of course may be selected). It may be desirable to have a fewer number of packaged in the cartridges. However, to prevent the cartridges from appearing empty, and to prevent the product packages from moving loosely in the cartridges, universal spacer 30 may be used. As shown in Steps 5 and 6 of FIG. 18, each spacer 30 as a central panel that is approximately the width of the interior space of an erected cartridge, and several successive pairs of side panels, the width of each being approximately the depth of one, or a predetermined multiple of product packages standing upright. By selectively folding the side panels of the universal spacer 30, a dunnage device having a depth equivalent to a predetermined multiple of product packages is created to occupy the space that would have otherwise been occupied by product packages in a "full" cartridge.

FIG. 19 illustrates the steps in erecting a tower 148, and the initial steps in fabricating a modular three-tower display. Flaps 70, 72, 74, 76 are fold in and the blank for tower shell 38 is laid face down on a surface. Three cartridges are laid with their open sides face down, and the elongated slots toward what will be the narrow, top end of the tower. The flaps from the shell blank will be to the outside of the three cartridges. (Step 1 of FIG. 19) Tabs 138–144 will project upwardly.

Brace 36 is folded so that side panels 92 and 94 are perpendicular to center panel 90. Support walls 96 and 98 are folded perpendicular to center panel 90, extending away from center panel 90 in an opposite direction to side panels 92, 94. Locking support walls 100 and 104 are folded toward one another, with slits 102 and 106 "intersecting", so that the two locking support walls interdigitate, with a top portion of one locking support wall to the outside of the other, and the bottom portion of the other locking support wall to the outside of the first. Brace 36 is then placed down on the backs of cartridges 44, with side panels 92, 94 projecting upwardly. Vertical slots 108 and horizontal slots 110 are aligned with respective ones of tabs 138–144 on each of cartridges 44, until the tabs pass through the slots. (Step 2 of FIG. 19).

Side walls 48 and 50 are then folded around, until back wall 52 covers the back of brace 36, and abuts the free edges of side panels 92 and 94. Tabs 54 are then inserted into slots 58, and top wall 60 is folded down, and tab 68 is inserted into slot 84. (Step 3 of FIG. 19).

This procedure completes the assembly of one point of purchase display tower 148. When cartridges 44 are filled with product packages, tabs 80 help prevent the packages from simply falling out of the cartridges. Instead, the product packages (not shown) must be tipped and lifted slightly to clear the tabs 80.

If it is desired to form a three-tower modular display, bottom form 34 is erected, as previously described. (Step 4 of FIG. 19) Center form 32 is then erected, as previously described (Step 5 of FIG. 19) Center form 32 is then placed in the center of bottom form 34. Each tower 148 is placed into a branch of bottom form 34, and a folding panel 88 is pulled out from the back of each respective tower, and inserted into a corresponding slot 178 in center form 32. (Step 6 of FIG. 19)

Top lock 40 is then erected (Step 1 of FIG. 20) and placed atop the center form 32. Tabs 198 and 200 of each branch are then inserted into slots 82 on the sides of the tower shells 38. (Step 2 of FIG. 20) The side panels 42 are attached by folding the thin panels 204 and 206 back upon the center panel 202. Adhesive strips (not shown) will be placed on the sides of thin panels 204 and 206 that will bear against the sides of the towers. Tabs 208 and 210 will be received in suitably located slots in the front edges of the towers 148. (Step 3 of FIG. 20) A center filler 28 is then folded into a tube, and affixed, as by inserting the tab (FIG. 1) into a suitably located slot. Filler 28 is then dropped into the space above the top lock 40. Small articles, such as lug-ons may be placed in the open center filler 28. (Step 4 of FIG. 20)

If it is desired to actually ship a fully erected and loaded three-tower display, then first top and bottom caps 24 are erected by folding up the sides and inserting the tabs into the slots that are provided. See FIG. 1 for a plan view of the blank for caps 24. (Step 5 of FIG. 20) The pyramid of three towers is then placed into a bottom cap 24. The sides of the top shipping filler 26 (see FIG. 1 for a plan view of the blank) are then placed atop the center filler 28. Shroud 22 is folded along its vertical fold lines, and inserted between the bottoms of the towers and the wall of the bottom cap. Top cap 24 is then placed atop the top edges of shroud 22. Suitable straps may secure the package.

A still further alternative embodiment of the invention is a countertop point of purchase display that continues the theme of the tower shape and the use of cartridges to hold the product packages of the previously described embodiments.

Figure 14:
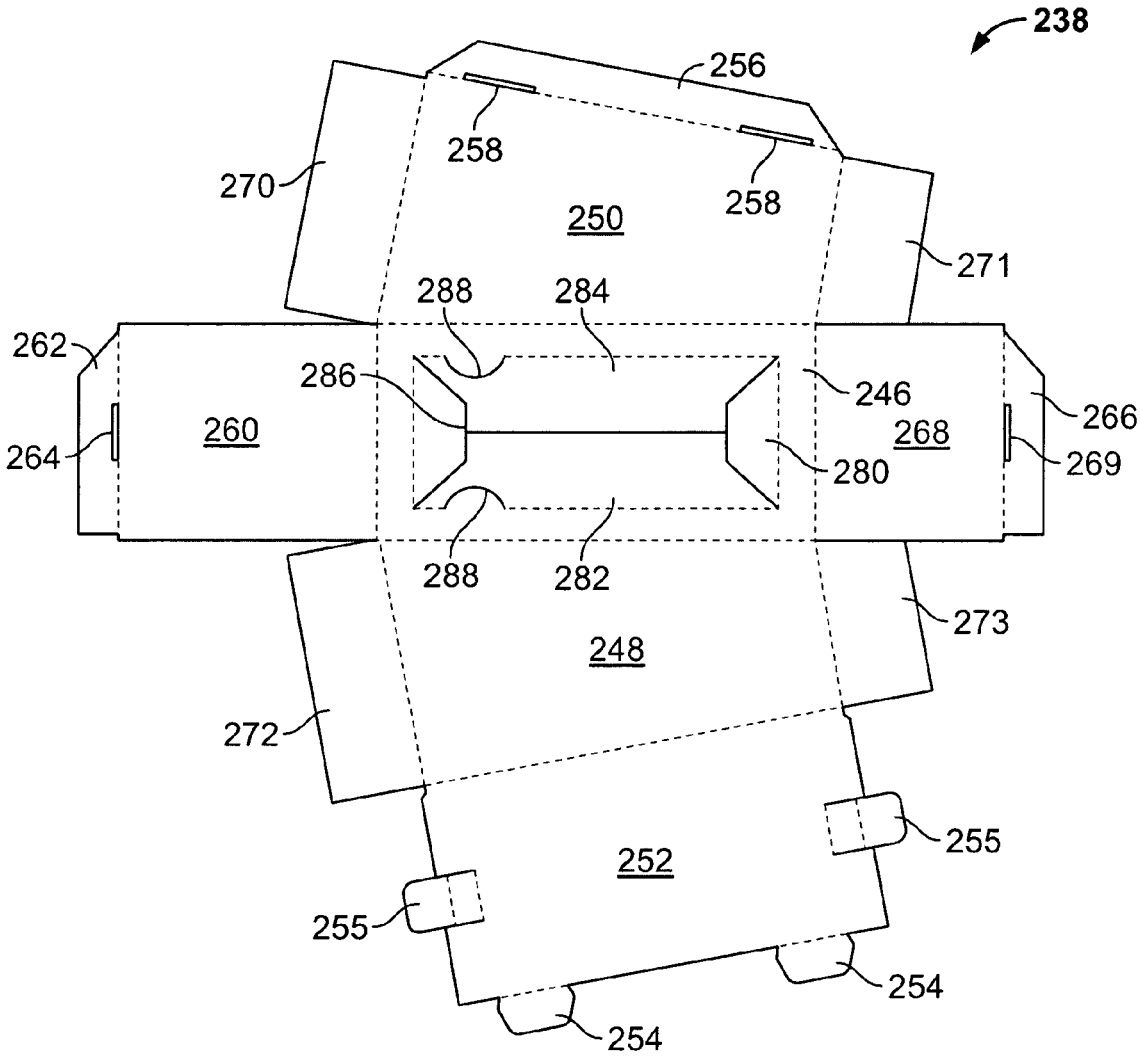
FIG. 14 is a plan view of a blank for a countertop point of purchase display, in an alternative embodiment of the present invention.

FIG. 14 is a plan view of a blank for a countertop point of purchase display, in an alternative embodiment of the present invention.

Mini tower shell 238 is preferably formed from a single blank of corrugated paperboard material, as shown in FIG. 14. The dashed lines typically indicate fold lines, and solid lines typically indicate cuts, free edges or the crease or edge resulting from a fold, when located in an interior portion of a view. This convention shall apply to the remaining Figures in this present disclosure, unless otherwise specified. One of ordinary skill in the art, having the present disclosure before them, will be able to readily perceive and identify such fold lines, cuts, free edges, creases or edges.

The blank for tower shell 238 comprises outer wall 246, sidewalls 248 and 250, back wall 252, with side tabs 254 and top and bottom tabs 255. Strip 256 emanates from sidewall 250, to permit the formation of slots 258. The blank also includes top wall 260, and locking panel 262, with slot 264. Locking panel 266 emanates from bottom wall 268, with slot 269. Flaps 270, 271 emanate from side wall 250. Flaps 272, 273 emanate from side wall 248. Cuts in outer wall 246 form flaps 280, 282, 284, 286. Arcuate cuts 288 form arcuate tabs 290, when flaps 280, 282, 284, 286 are folded inwardly. Slots 82 and 84 are also provided, as is U-shaped cut 86 that forms folding panel 88.

Figure 15:
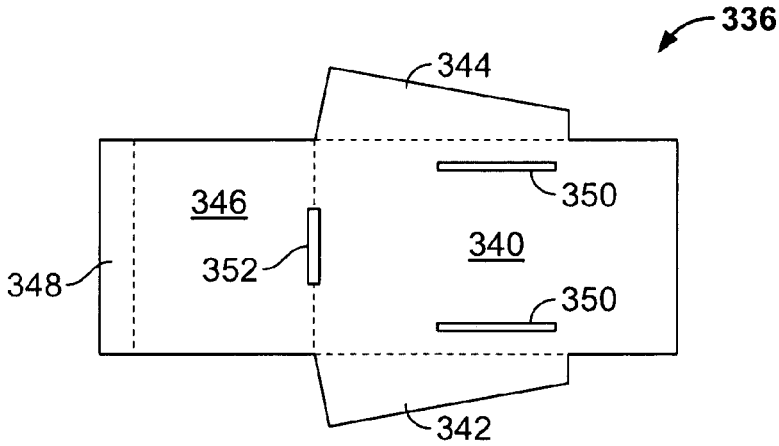
FIG. 15 is a plan view of a blank for a support for the countertop point of purchase display of FIG. 14.

FIG. 15 is a plan view of a blank for a support for the countertop point of purchase display of FIG. 14. Brace 336 comprises center panel 340, side panels 342 and 344 and support wall 346 with flap 348. Vertical slots 350 and horizontal slot 352 are also provided.

Figure 16:
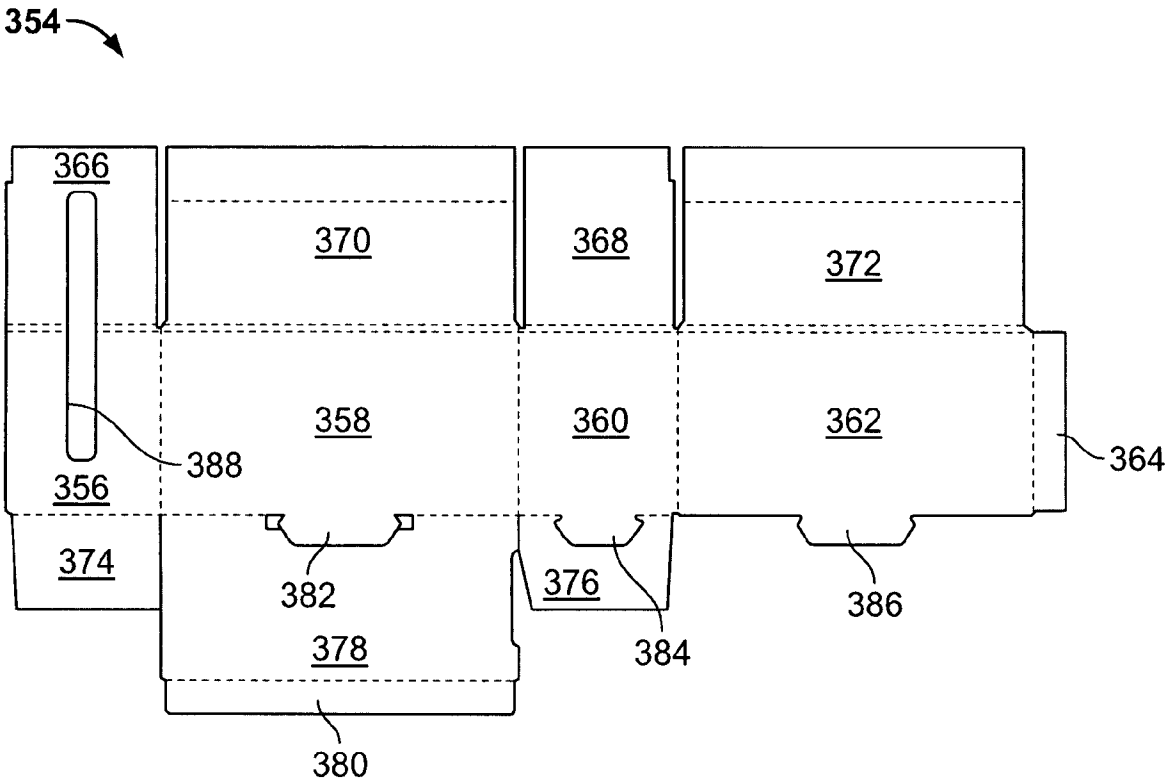
FIG. 16 is a plan view of a blank for a cartridge for the countertop point of purchase display of FIG. 14.

FIG. 16 is a plan view of a blank for a cartridge for the countertop point of purchase display of FIG. 14. The blank for cartridge 354 preferably comprises outer panels 356, 358, 360, 362. Attachment web 364 emanates from outer panel 362. Top side panels 366, 368 emanate from outer panels 356 and 360, respectively. Top length panels 370, 372 emanate from outer panels 358, 362, respectively. Bottom end panels 374, 376, emanate from outer panels 356, 360, respectively. Bottom length panel 378 emanates from outer panel 358. Flap 380 extends from bottom length panel 378. Tabs 382, 384, and 386 are formed preferably by appropriate die cuts. Elongated generally rectangular slot 388 is formed in outer panel 356 and top side panel 366. Cartridge 354 is erected in a manner substantially identical to that of cartridge 44.

Figure 17:
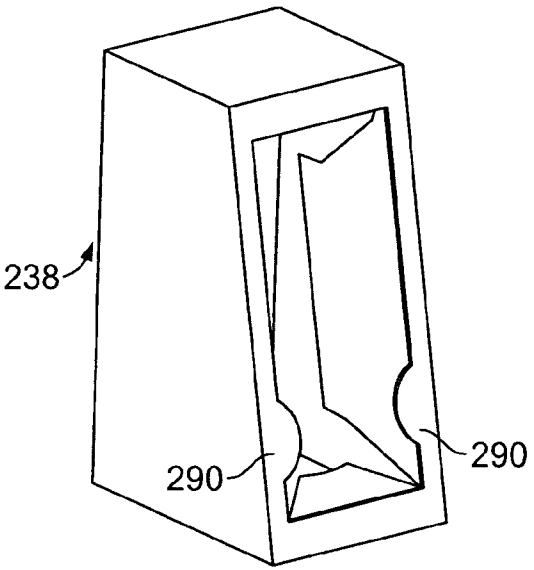
FIG. 17 is a perspective view of an erected countertop point of purchase display.

FIG. 17 is a perspective view of an erected countertop point of purchase display 239. Assembly of display 239 is accomplished by assembling cartridge 354, folding flaps 280, 282, 284 and 286, setting mini tower shell 238 face down, and placing cartridge 354 open side down on the shell blank, so that the flaps are on the inside of the opening of the cartridge. Brace 336 is connected to the back of cartridge 354, by aligning center panel 340 so that vertical slots 350 align with and receive tabs 382 and 386, and horizontal slot 352 aligns with and receives tab 384. Support wall 346 is folded to an acute angle relative to center panel 340, and flap 348 is folded up relative to support wall 346. Shell 238 is folded around cartridge 354 and brace 336, by folding up the side panels 250, 252, folding in flaps 270–273, folding up top panel 260 and bottom panel 268, and folding over back panel 252 across the back of cartridge 354, and tucking tabs 254 into slots 258, and tabs 255 into slots 264 and 269.

Figure 21:
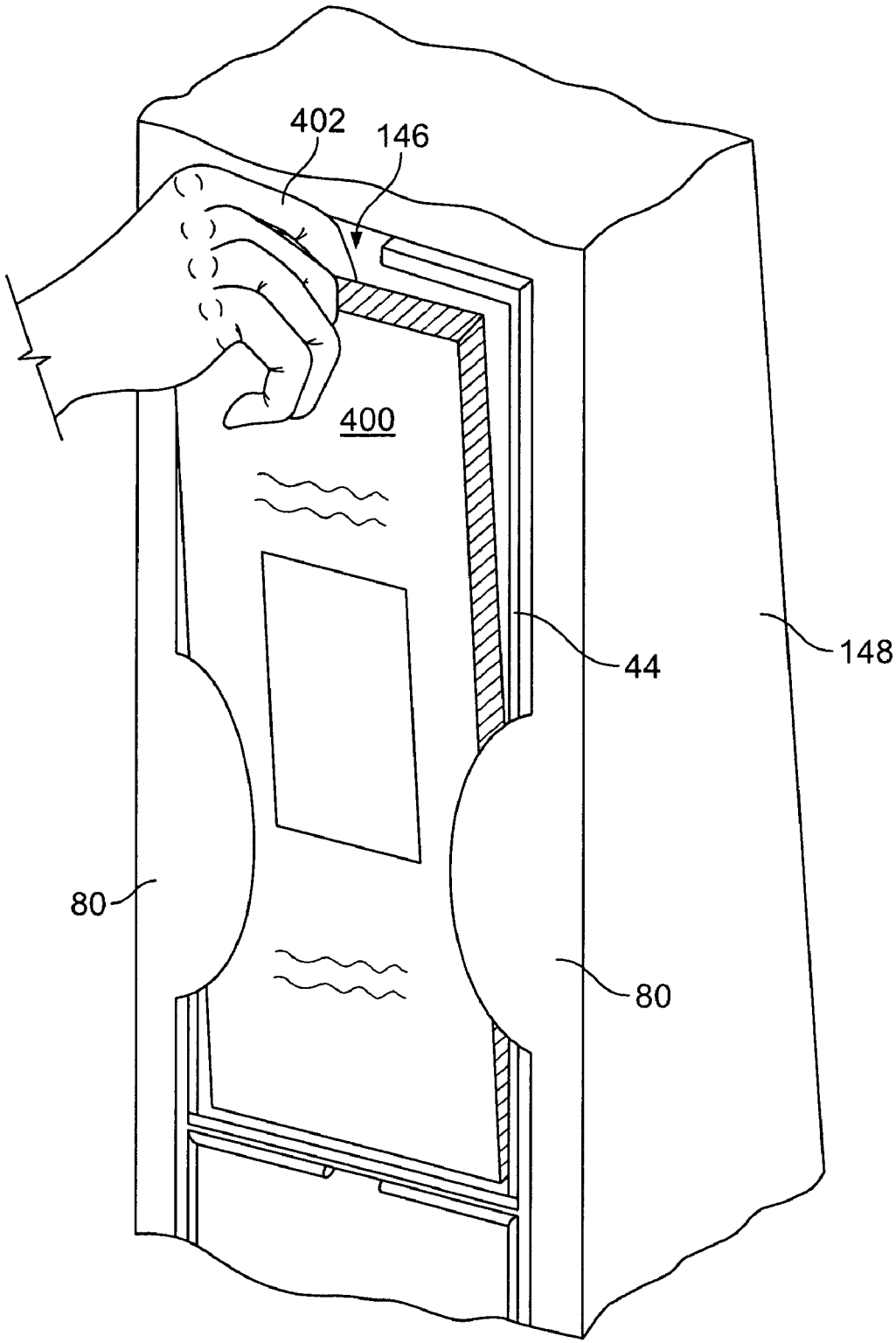
FIG. 21 is a perspective fragmentary view of a tower display according to one of the embodiments of the present invention, showing the product removal control feature in effect.

Each of the three illustrated and described embodiments includes as a key feature, a product removal control system. As demonstrated in FIG. 21, in which a fragment of a display tower 148 is shown, in which the topmost cartridge 44 is filled with packages 400 (e.g., DVD boxes) and/or a universal spacer (not shown). Preferred embodiments of the invention, the relative dimensions of the height, width and depth of the cartridges, and the relative positioning of tabs 80 (or tabs 290 in the tabletop version) with respect to the top of the cartridge 44 behind a respective pair of tabs 80, are selected so that it is extremely difficult, if not impossible to remove more than one package at a time, without bending out the tabs 80, or otherwise mutilating the display structure. Removal of a package is accomplished by a person inserting a finger 402 into cartridge 44, aided in this by the open end of slot 146. The person then pulls the upper end of the one package 400, until a secure grip is attained. This causes the package to lean outwardly, around the points of contact between the face of the package and an upper edge of each of tabs 80. The person then lifts the package upwardly and away from display 148. As successive packages are removed from any one cartridge 44, it does become easier to remove each individual package; however, the distance between the top of each cartridge and the top edges of tabs 80 should be selected so that at no time can two or more packages be simultaneously pulled from the display, without doing detectable damage to the display structure.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

We claim:

1. A point of purchase display apparatus for the facilitated display of products, comprising:

at least one cartridge, having an open face, for containing a plurality of products, the at least one cartridge having a top wall, at least one side wall and a bottom wall, with attachment tabs emanating rearwardly from at least two of the top wall, at least one side wall and bottom wall;

at least one self-supporting display shell having a display opening in a face thereof;

the at least one self-supporting display shell being operably configured for enabling positioning of the open face of the at least one cartridge in alignment with at least a portion of the display opening of the at least one self-supporting display shell; and at least one brace member, operably configured for supporting the at least one cartridge within the at least one self-supporting display shell, to place the open face of the at least one cartridge in alignment with at least a portion of the display opening of the at least one self-supporting display shell, the at least one brace member being operably configured to insertingly receive the attachment tabs emanating rearwardly from at least two of the top wall, at least one side wall and bottom wall.

2. A point of purchase display apparatus for the facilitated display of products, comprising:

at least one cartridge, having an open face, for containing a plurality of products;

at least one self-supporting display shell having a display opening in a face thereof;

the at least one self-supporting display shell being operably configured for enabling positioning of the open face of the at least one cartridge in alignment with at least a portion of the display opening of the at least one self-supporting display shell; and at least one brace member, operably configured for supporting the at least one cartridge within the at least one self-supporting display shell, to place the open face of the at least one cartridge in alignment with at least a portion of the display opening of the at least one self-supporting display shell; and means for controlling removal of products from the display, operably configured to substantially preclude the simultaneous removal of more than one product from a single cartridge from the display apparatus.

3. The point of purchase display apparatus according to claim 2, wherein the means for controlling removal of products from the display comprises at least one tab member operably emanating from a side edge of the display opening, the at least one tab member being further operably located, relative to the open face of the at least one cartridge, so that not more than one product can pass between an edge of the open face of the at least one cartridge and the at least one tab member, without requiring destructive mutilation of at least some portion of the display apparatus.

4. The point of purchase display apparatus according to claim 2, wherein the display shell is operably configured to enable a plurality of cartridges to be positioned with their open faces in alignment with portions of the display opening.

5. The point of purchase display apparatus according to claim 4, wherein the brace member is operably configured for supporting the plurality of cartridges with their open faces in alignment with portions of the display opening.

6. The point of purchase display apparatus according to claim 2, comprising:

a plurality of self-supporting display shells, each display shell being provided with at least one brace member, supporting at least one cartridge.

7. The point of purchase display apparatus according to claim 6, wherein each of the plurality of self-supporting display shells are substantially identical in configuration.

8. The point of purchase display apparatus according to claim 6, further comprising means for modularly connecting the plurality of self-supporting display shells.

9. The point of purchase display apparatus according to claim 7, wherein the means for modularly connecting the plurality of self-supporting display shells comprises:

a bottom form structure, operably configured to receive and stabilize bottom ends of at least two self-supporting display shells;

a standing form operably configured to engage and connect at least two self-supporting display shells to one another.

10. The point of purchase display apparatus according to claim 9, wherein the means for modularly connecting the plurality of self-supporting display shells further comprises:

a lock member operably configured to engage and connect at least two self-supporting display shells to one another.

11. The point of purchase display apparatus according to claim 6, further comprising means for facilitating transportation of the plurality of self-supporting display shells, each display shell being provided with at least one brace member, supporting at least one cartridge, said means for facilitating transportation comprising:

a bottom cap, operably configured to receive and stabilize bottom ends of at least two self-supporting display shells;

a top filler member, operably configured to rest atop top ends of at least two self-supporting display shells;

a top cap, operably configured to receive and stabilize the top filler member, and, in turn, top ends of at least two self-supporting display shells; and a shroud, operably configured to surround at least two self-supporting display shells;

the bottom cap being further operably configured to receive and restrain a bottom edge region of the shroud;

the top cap being further operably configured to receive and restrain a top edge region of the shroud.

12. The point of purchase display apparatus according to claim 1, further comprising means for controlling removal of products from the display, operably configured to substantially preclude the simultaneous removal of more than one product from a single cartridge from the display apparatus.

13. The point of purchase display apparatus according to claim 12, wherein the means for controlling removal of products from the display comprises at least one tab member operably emanating from a side edge of the display opening, the at least one tab member being further operably located, relative to the open face of the at least one cartridge, so that not more than one product can pass between an edge of the open face of the at least one cartridge and the at least one tab member, without requiring destructive mutilation of at least some portion of the display apparatus.

14. The point of purchase display apparatus according to claim 1, wherein the display shell is operably configured to enable a plurality of cartridges to be positioned with their open faces in alignment with portions of the display opening.

15. The point of purchase display apparatus according to claim 14, wherein the brace member is operably configured for supporting the plurality of cartridges with their open faces in alignment with portions of the display opening.

16. The point of purchase display apparatus according to claim 1, comprising:

a plurality of self-supporting display shells, each display shell being provided with at least one brace member, supporting at least one cartridge.

17. The point of purchase display apparatus according to claim 16, wherein each of the plurality of self-supporting display shells are substantially identical in configuration.

18. The point of purchase display apparatus according to claim 16, further comprising means for modularly connecting the plurality of self-supporting display shells.

19. The point of purchase display apparatus according to claim 17, wherein the means for modularly connecting the plurality of self-supporting display shells comprises:

a bottom form structure, operably configured to receive and stabilize bottom ends of at least two self-supporting display shells;

a standing form operably configured to engage and connect at least two self-supporting display shells to one another.

20. The point of purchase display apparatus according to claim 19, wherein the means for modularly connecting the plurality of self-supporting display shells further comprises:

a lock member operably configured to engage and connect at least two self-supporting display shells to one another.

21. The point of purchase display apparatus according to claim 16, further comprising means for facilitating transportation of the plurality of self-supporting display shells, each display shell being provided with at least one brace member, supporting at least one cartridge, said means for facilitating transportation comprising:

a bottom cap, operably configured to receive and stabilize bottom ends of at least two self-supporting display shells;

a top filler member, operably configured to rest atop ends of at least two self-supporting display shells;

a top cap, operably configured to receive and stabilize the top filler member, and, in turn, top ends of at least two self-supporting display shells; and a shroud, operably configured to surround at least two self-supporting display shells;

the bottom cap being further operably configured to receive and restrain a bottom edge region of the shroud;

the top cap being further operably configured to receive and restrain a top edge region of the shroud.

22. A point of purchase display apparatus for the facilitated display of products, comprising:

at least one cartridge, having an open face, for containing a plurality of products;

at least one self-supporting display shell having a display opening in a face thereof;

the at least one self-supporting display shell being operably configured for enabling positioning of the open face of the at least one cartridge in alignment with at least a portion of the display opening of the at least one self-supporting display shell; and at least one brace member, operably configured for supporting the at least one cartridge within the at least one self-supporting display shell, to place the open face of the at least one cartridge in alignment with at least a portion of the display opening of the at least one self-supporting display shell;

all of which are fabricated primarily from at least one of a paper, a paperboard, and a corrugated paperboard material.

* * * * *